US009220145B2

(12) United States Patent
Brandt

(10) Patent No.: US 9,220,145 B2
(45) Date of Patent: Dec. 22, 2015

(54) TRANSFORMER VOLTAGE DETECTION IN DIMMABLE LIGHTING SYSTEMS

(71) Applicant: TerraLux, Inc., Longmont, CO (US)

(72) Inventor: Brian Brandt, Longmont, CO (US)

(73) Assignee: TerraLUX, Inc., Longmont, CO (US)

( * ) Notice: Subject to any disclaimer, the term of this patent is extended or adjusted under 35 U.S.C. 154(b) by 0 days.

(21) Appl. No.: 14/533,572

(22) Filed: Nov. 5, 2014

(65) Prior Publication Data

US 2015/0123567 A1 May 7, 2015

Related U.S. Application Data

(63) Continuation of application No. 13/714,928, filed on Dec. 14, 2012, now Pat. No. 8,907,588.

(60) Provisional application No. 61/576,449, filed on Dec. 16, 2011.

(51) Int. Cl.
*H05B 37/02* (2006.01)
*H05B 33/08* (2006.01)

(52) U.S. Cl.
CPC ..... *H05B 33/0845* (2013.01); *H05B 33/0815* (2013.01); *H05B 37/02* (2013.01); *H05B 37/0227* (2013.01)

(58) Field of Classification Search
CPC ..... H05B 37/02; H05B 37/0281; H05B 33/0815; H05B 41/2822; H05B 41/2827; H05B 33/0845; H05B 37/0227; Y02B 20/42; Y02B 20/44; G01R 19/04
USPC ..... 315/254, 274, 276, 291, 282, 294, 312, 315/360, 194, DIG. 4; 323/234, 243, 247; 324/76.15, 76.22, 76.55, 76.61
See application file for complete search history.

(56) References Cited

U.S. PATENT DOCUMENTS

| | | | | |
|---|---|---|---|---|
| 5,808,422 | A | 9/1998 | Venkitasubrahmanian et al. | |
| 7,466,565 | B2 | 12/2008 | Tanaka | |
| 8,294,377 | B2 | 10/2012 | Kang et al. | |
| 8,400,079 | B2 | 3/2013 | Kanamori et al. | |
| 8,674,627 | B2 | 3/2014 | Hwang et al. | |
| 8,907,588 | B2 * | 12/2014 | Brandt | 315/294 |
| 2008/0042627 | A1 | 2/2008 | Shin et al. | |
| 2011/0115400 | A1 | 5/2011 | Harrison et al. | |
| 2011/0121751 | A1 * | 5/2011 | Harrison et al. | 315/291 |

(Continued)

FOREIGN PATENT DOCUMENTS

| | | | |
|---|---|---|---|
| EP | 2410821 | A2 | 1/2012 |
| WO | 2009/013656 | A1 | 1/2009 |

(Continued)

OTHER PUBLICATIONS

PCT International Patent Application No. PCT/US2012/69715, International Search Report and Written Opinion mailed Jul. 2, 2013, 8 pages.

(Continued)

*Primary Examiner* — Haissa Philogene
(74) *Attorney, Agent, or Firm* — Neugeboren O'Dowd PC

(57) ABSTRACT

An illumination system detects a peak value of a voltage of a transformer supplying an LED module by analyzing the current value of the voltage and an on-time of the voltage. Based on the detected peak value, a property of the illumination system is adjusted.

14 Claims, 6 Drawing Sheets

(56) References Cited

U.S. PATENT DOCUMENTS

| | | | |
|---|---|---|---|
| 2011/0193488 | A1 | 8/2011 | Kanamori et al. |
| 2011/0248637 | A1 | 10/2011 | Mitsuyasu et al. |
| 2011/0316446 | A1 | 12/2011 | Kang et al. |
| 2013/0187564 | A1 | 7/2013 | Brandt |

FOREIGN PATENT DOCUMENTS

| | | | |
|---|---|---|---|
| WO | 2011/008635 | A1 | 1/2011 |
| WO | 2011/045371 | A1 | 4/2011 |
| WO | 2011/145009 | A1 | 11/2011 |

OTHER PUBLICATIONS le;.5qLazaridis Giorgos, "Voltage Controlled AC Light Dimmer", PCB Heaven, available online at <http://www.pcbheaven.com/circuitpages/Voltage_Controlled_AC_Light_Dimmer>, Jan. 1, 2010, pp. 1-15.

TLC (Southern) Ltd., "250w/400w 2 Way Silent Trailing Edge & LED Dimmer—Module Push On/Off Dimmer", available online at <http://www.tlc-direct.co.uk/Products/VLJP400MOD.html>, retrieved on Apr. 16, 2013, pp. 1-2.

PCT International Patent Application No. PCT/US2012/069715, International Preliminary Report on Patentability mailed Jun. 26, 2014, 7 pages.

* cited by examiner

TRANSFORMER VOLTAGE DETECTION IN DIMMABLE LIGHTING SYSTEMS

CROSS-REFERENCE TO RELATED DOCUMENTS

This application claims priority to and the benefit of U.S. Provisional Patent Application Ser. No. 61/576,449, filed on Dec. 16, 2011, which is hereby incorporated herein by reference in its entirety.

TECHNICAL FIELD

In various embodiments, the present invention relates to lighting systems and, in particular, to LED lighting systems having integrated detection circuitry.

BACKGROUND

LED light sources (i.e., LED lamps or, more familiarly, LED "light bulbs") provide an energy-efficient alternative to traditional types of light sources and may be used as a "drop-in" replacement in a lighting system in place of an incandescent, halogen, or florescent bulb. LED light sources typically require specialized circuitry to properly power the LED(s) within the light source, however, and this support circuitry must be compatible with the rest of the existing lighting system and circuitry (i.e., the circuitry that was formerly used or designed to power and control the incandescent, halogen, or florescent bulb). For example, different types of transformers and dimmer circuits may be already installed in a lighting system, and the LED light source must interface with these circuits.

A typical transformer may supply either a 12 V or 24 V nominal voltage in a lighting system. An LED light source receiving this voltage may behave differently when it receives a 12 V supply instead of a 24 V supply; for example, the LED may appear brighter when the light source receives the 24 V supply. This sort of variation in the light that a user of the LED light experiences is undesirable; ideally, the LED light source provides a consistent user experience that is independent of the type of circuitry used. Other circuits within the LED light source may also be affected; a bleeder circuit, for example, may overheat when exposed to a 24 V input.

The LED light source may attempt to detect the peak voltage level of the transformer, but this detection may be difficult because a dimmer circuit may vary the voltage before the LED circuit sees it. For example, it may be difficult to distinguish between (a) an incoming 12 V signal is being generated by a 12 V transformer and a dimmer circuit running at 0% dimming and (ii) a 24 V transformer and a dimmer circuit running at 50% dimming. A need therefore exists for a system and method for detecting the peak voltage of a transformer even if that voltage is modified by a dimmer circuit prior to detection.

SUMMARY

In various embodiments, the present invention detects a peak voltage level of a transformer by analyzing (i) a current peak value of a supplied voltage and (ii) an amount of dimming applied to the supplied voltage. If, for example, the peak value of the supplied voltage is low, but an amount of dimming is high (e.g., there is a high phase angle/amount of clipping evident in the supplied voltage) the value of the peak voltage of the transformer is deemed higher than the supplied voltage. One or more properties of the LED circuitry may be modified in response to the detected peak voltage to thereby provide a consistent user experience independent of transformer peak voltage value. In one embodiment, an amount of current supplied to the LED is reduced if a high peak value (e.g., 24 V) is detected. In another embodiment, a bleeder circuit (e.g., a bleeder resistor) receives less bleeder current if a high peak value is detected.

In one aspect, a method determines a nominal voltage of a transformer electrically connected to an illumination system that includes a light source and a dimmer. The transformer supplies a voltage waveform (having either a first nominal voltage or a second nominal voltage less than the first nominal voltage). Each of the first and second nominal voltages falls within different but overlapping voltage ranges. A peak voltage of the voltage waveform supplied by the transformer to the illumination system is determined. If the peak voltage is less than a minimum voltage of the voltage-range overlap, the nominal voltage of the transformer is identified as the second nominal voltage; if the peak voltage is greater than a maximum voltage of the voltage-range overlap, the nominal voltage of the transformer is identified as the first nominal voltage. If the peak voltage falls within the voltage-range overlap, the nominal voltage is identified as either the first or second nominal voltage based at least in part on an on time of the voltage waveform supplied by the transformer to the illumination system.

A property of the illumination system may be adjusted in accordance with the identified nominal voltage. The adjusted property may include a current supplied to an LED or a current drawn by a bleeder circuit. If the peak voltage falls within the voltage-range overlap, the nominal voltage may be determined by at least one of (i) comparing the on time to a predetermined threshold or (ii) comparing a ratio of the on time to the peak voltage to a second predetermined threshold. If the on time is greater than the predetermined threshold, the nominal voltage of the transformer may be identified as the second nominal voltage; if the on time is less than or equal to the predetermined threshold, the nominal voltage of the transformer may be identified as the first nominal voltage. The ratio of the on time to the peak voltage may be compared to the second predetermined threshold; if the ratio of the on time to the peak voltage is greater than the second predetermined threshold, the nominal voltage of the transformer may be identified as the second nominal voltage, and if the ratio of the on time to the peak voltage is less than or equal to the second predetermined threshold, the nominal voltage of the transformer may be identified as the first nominal voltage. The first nominal voltage may be approximately 24 V and the second nominal voltage may be approximately 12 V.

In another aspect, a method of determining a nominal voltage of a transformer supplying a voltage waveform to an illumination system includes determining a peak voltage of the voltage waveform supplied by the transformer to the illumination system; determining an on time of the voltage waveform supplied by the transformer to the illumination system; and determining the nominal voltage based at least in part on the on time.

The nominal voltage may be determined by at least one of (i) comparing the on time to a predetermined threshold or (ii) comparing a ratio of the on time to the peak voltage to a second predetermined threshold. A current supplied to an LED or a current drawn by a bleeder circuit may be adjusted in accordance with the determined nominal voltage.

In another aspect, a circuit for determining a nominal voltage of a transformer includes a comparator for (i) determining a peak voltage of a voltage waveform supplied by the transformer and (ii) determining an on time of the voltage waveform; a memory for storing at least one predetermined threshold associated with at least one of on time or a ratio of on time to peak voltage; and an analyzer for determining the nominal voltage of the transformer based at least in part on the on time of the voltage waveform. The analyzer may determine the nominal voltage of the transformer based in part on the peak voltage of the voltage waveform. The analyzer may adjust a current supplied to an LED or a current drawn by a bleeder circuit in accordance with the determined nominal voltage.

In another aspect, an illumination system includes at least one light source and a transformer for supplying a voltage waveform to the at least one light source. A circuit includes a comparator for (i) determining a peak voltage of the voltage waveform and (ii) determining an on time of the voltage waveform; a memory for storing at least one predetermined threshold associated with at least one of on time or a ratio of on time to peak voltage; and an analyzer for determining the nominal voltage of the transformer based at least in part on the on time of the voltage waveform. A dimmer may dim light emitted by the at least one light source by modifying an input to the transformer. The analyzer may adjust a current supplied to an LED or a current drawn by a bleeder circuit in accordance with the determined nominal voltage.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. In the following description, various embodiments of the present invention are described with reference to the following drawings, in which.

DESCRIPTION

Figure 1:
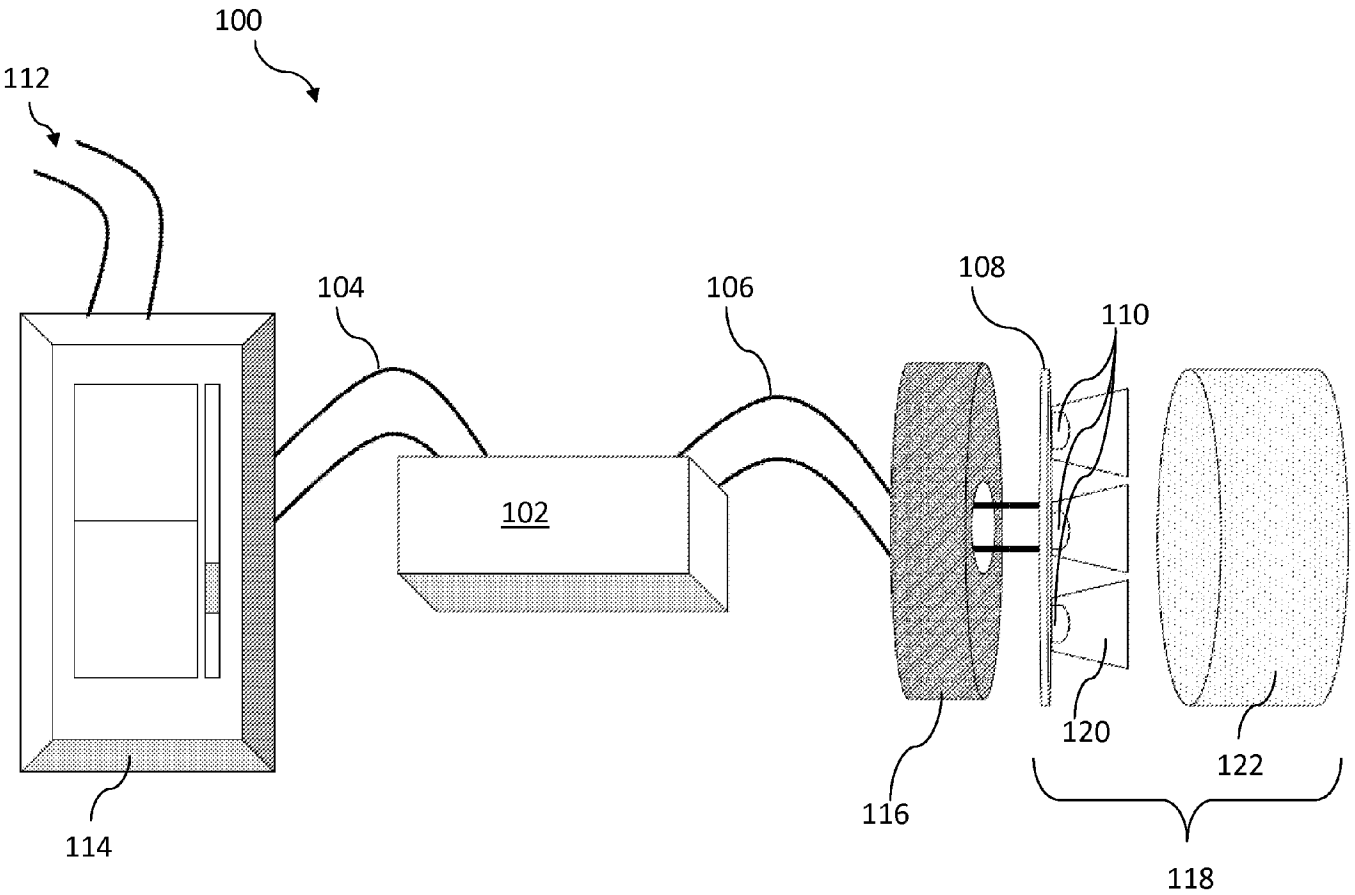
FIG. 1 is a block diagram of an LED lighting circuit in accordance with an embodiment of the invention.

FIG. 1 illustrates a block diagram 100 of an exemplary embodiment of the present invention. A transformer 102 receives a transformer input signal 104 and provides a transformed output signal 106. The transformer 102 may be a magnetic transformer or an electronic transformer, and the output signal 106 may be a low-frequency (i.e. less than or equal to approximately 120 Hz) AC signal or a high-frequency (e.g., greater than approximately 120 Hz) AC signal, respectively. The transformer 102 may be, for example, a 5:1 or a 10:1 transformer providing a stepped-down 60 Hz output signal 106 (or output signal envelope, if the transformer 102 is an electronic transformer). The transformer output signal may have a peak value of 12 V, 24 V, or any other voltage known in the art. The transformer output signal 106 is received by an LED module 108, which converts the transformer output signal 106 into a signal suitable for powering one or more LEDs 110. In various embodiments, the transformer input signal 104 may be an AC mains signal 112, or it may be received from a dimmer circuit 114. The dimmer circuit may be, for example, a wall dimmer circuit or a lamp-mounted dimmer circuit. A conventional heat sink 116 may be used to cool portions of the LED module 108. The LED module 108 and LEDs 110 may be part of an LED assembly (also known as an LED lamp or LED "bulb") 118, which may include aesthetic and/or functional elements such as lenses 120 and a cover 122. The LED module 108 may include a rigid member suitable for mounting the LEDs 110, lenses 120, and/or cover 120. The rigid member may be (or include) a printed-circuit board, upon which one or more circuit components may be mounted. The circuit components may include passive components (e.g., capacitors, resistors, inductors, fuses, and the like), basic semiconductor components (e.g., diodes and transistors), and/or integrated-circuit chips (e.g., analog, digital, or mixed-signal chips, processors, microcontrollers, application-specific integrated circuits, field-programmable gate arrays, etc.). The circuit components included in the LED module 108 combine to adapt the transformer output signal 106 into a signal suitable for lighting the LEDs 120. These circuits and/or modules are further described in, for example, U.S. Ser. No. 12/948,586, filed on Nov. 17, 2010, the entire disclosure of which is incorporated by reference herein.

Figure 2:
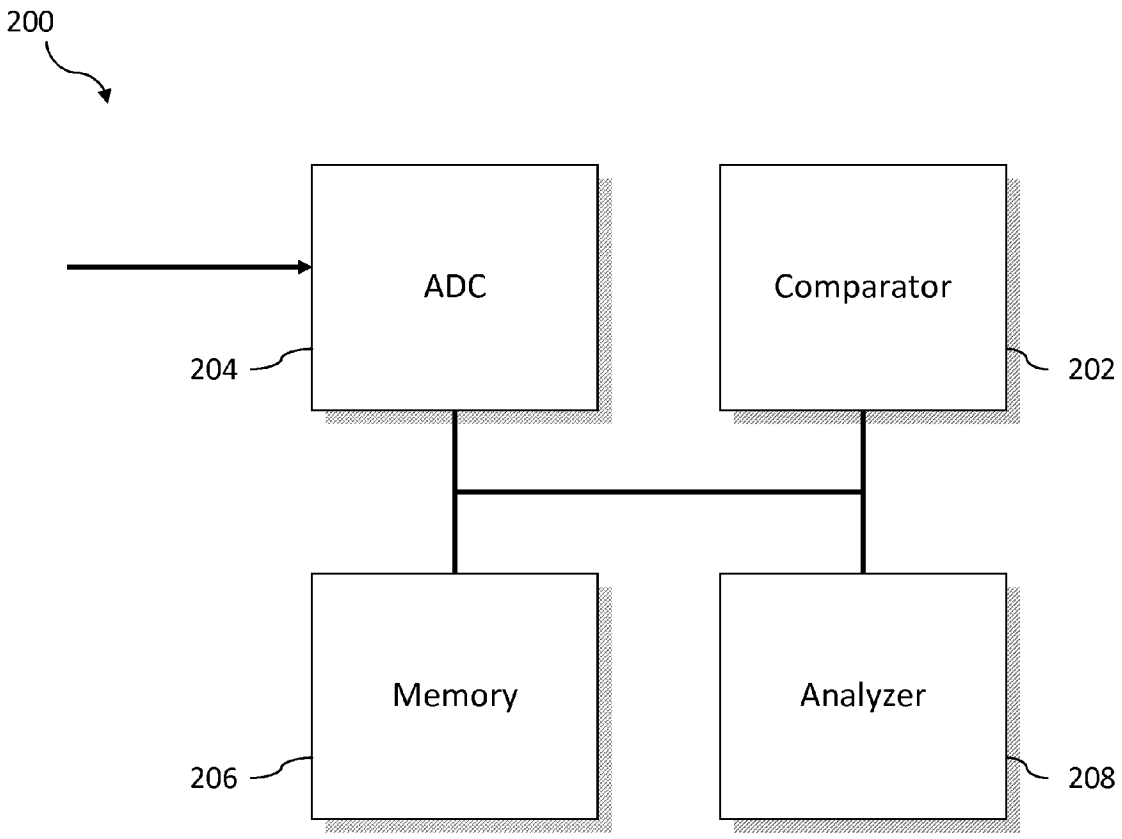
FIG. 2 is a block diagram of a circuit for detecting a peak voltage of a transformer in accordance with an embodiment of the invention.

In accordance with embodiments of the invention, the LED module 108 detects the peak output voltage of the transformer 102 and alters its behavior accordingly to provide a consistent user experience in using the LEDs 110 (e.g., a consistent and predictable level of light that is independent of the type of transformer 102) and/or to protect components within the system 100 (e.g., to protect a bleeder circuit from overheating). FIG. 2 illustrates a system 200 for detecting a peak value of a transformer voltage. In various embodiments, upon power-up of the LED module circuit, the peak voltage from the transformer 102 is sampled using a comparator 202 (which may be implemented in or using a processor 206, as noted above). An analog-to-digital converter 204 may be used to convert the input voltage to a digital value. An initial scan may be performed to determine the approximate range within which the peak voltage falls; this range may be narrowed by stepping the comparator reference voltage down until the transformer voltage is detected. The initial scan reduces the number of cycles needed to determine the peak voltage. In one embodiment, the type of power supply or transformer is also determined (e.g., utilizing an analyzer) based at least in part on the power signal received therefrom.

Figure 3:
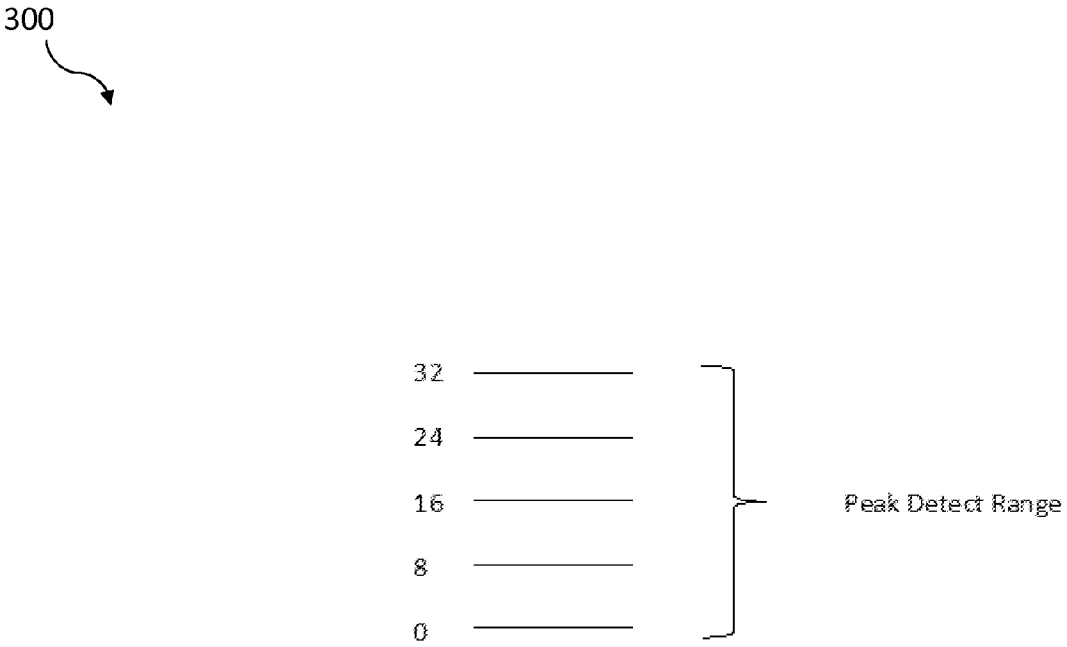
FIG. 3 is a scale of a range of transformer voltages in accordance with an embodiment of the invention.

FIG. 3 depicts a scale 300 representing the digital values of the comparator reference voltage, which in various embodiments roughly correlate to the voltages they represent. That is, in an embodiment, if the reference is set to eight, the voltage that will cause the comparator to "go high"—i.e., indicate the presence of a voltage—will be about eight volts. In an exemplary embodiment, the reference is initially set to eight (or another intermediate value in the scale of digital values), and if the comparator 202 does not trigger, the transformer voltage must be less than approximately eight volts. If the comparator 202 does trigger, the reference is incremented to a higher value, e.g., sixteen, and a corresponding absence of comparator output indicates that the transformer voltage is between approximately eight and sixteen volts. This procedure may be repeated until the range containing the transformer voltage is identified. Subsequently, another scan may be performed starting at the lowest digital value where the absence of voltage was sensed, and the value is decremented step-by-step until the voltage is sensed by the comparator, thereby identifying the peak voltage of the transformer. Preferably, each step has a dwell time of at least one (120 Hz) period. The detected voltage level is then preferably stored in non-volatile memory 206. As detailed above, due to the presence of a dimmer in the lighting system, this peak voltage does not necessarily identify the nominal operating voltage of the transformer.

After the peak voltage is identified, the "on time"—i.e., the extent of the unclipped portion of the incoming waveform—of the transformer voltage waveform is obtained. The on time is used to determine the approximate phase angle of the dimmer being used. In a preferred embodiment, an interrupt-based background task executed by a processor 208 fires on the rising and falling edges of the output signal of the comparator 202 that receives this waveform as an input, and the on time corresponds to the time period between the rising and falling edges of the voltage waveform. The processor/analyzer 208 and/or other circuitry (e.g., the comparator 202) may be a portion of (or implemented using) any kind of processor, e.g., a microprocessor, microcontroller, application-specific integrated circuit (ASIC), field-programmable gate array (FPGA), or any other type of digital-logic or mixed-signal circuit.

Typically a brighter dimmer setting yields a higher phase angle and a longer on time. The reference voltage for the comparator may be, e.g., a 10:1 voltage-divided input to the comparator with a threshold of approximately 0.2 V at the output of the divider. The threshold is preferably greater than zero to avoid the noise floor and thus provide a reliable signal.

Figure 4:
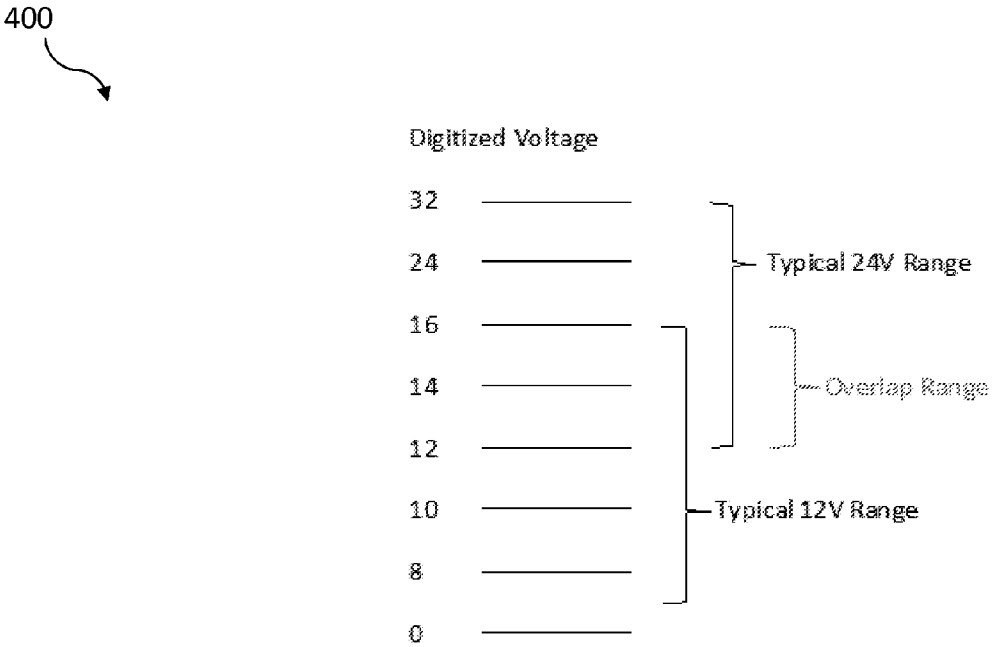
FIG. 4 is a scale of a range of overlapping transformer voltages in accordance with an embodiment of the invention.

In an exemplary embodiment, a 24 V transformer voltage signal at a low dimming level (i.e., "dim") appears similar to a 12 V transformer voltage signal at a high dimming level (i.e., "bright"). Thus, identification of the nominal transformer voltage level utilizes both the peak voltage and the on time identified as described above. FIG. 4 depicts a scale 400 of digitized voltage levels on which the "overlap" in dimmed voltage levels of 12 V and 24 V transformers is indicated (and, when operating in which, identification utilizing only the peak voltage is impossible).

In preferred embodiments, the nominal transformer voltage to be identified falls within at least one of the known ranges of two or more possible transformers being utilized with the lighting system. In the examples described herein, the two possible transformers supply nominal voltages of 12 V and 24 V, and the voltage may vary over a range containing that nominal value. The two ranges overlap at least partially. The peak voltage is determined as described above, and if it falls outside the range of overlap of the possible voltage ranges (e.g., falls below the minimum voltage that may be supplied by the 24 V transformer or above the maximum voltage that may be supplied by the 12 V transformer), then the transformer nominal voltage is determined by this polling of the peak voltage.

Figure 5:
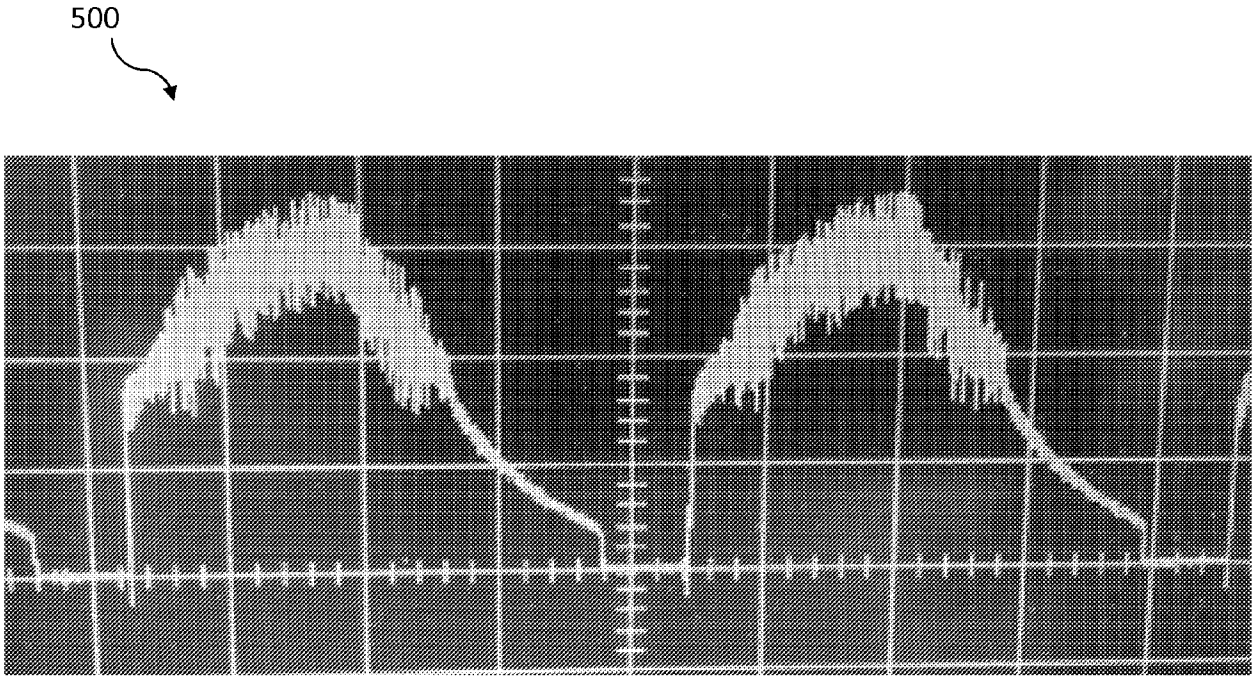
FIGS. 5 and 6 are waveforms of transformer output voltages in accordance with an embodiment of the invention.
Figure 6:
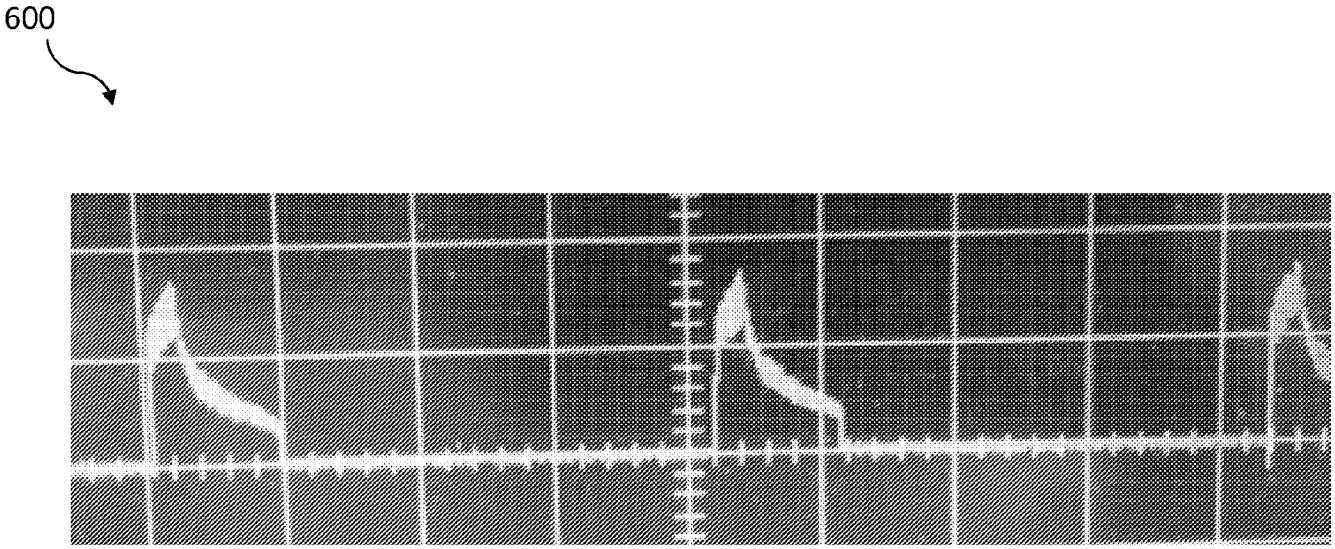

If the peak voltage falls within the range of overlap, however, the on time and/or the ratio of on time to peak voltage is utilized to determine the transformer nominal voltage. FIG. 5 depicts the transformer waveform 500 of a 12 V transformer in the overlap range indicated in FIG. 4, i.e., at a fairly high phase angle on the dimmer. FIG. 6 depicts the transformer waveform 600 of a 24 V transformer in the overlap range indicated in FIG. 4, i.e., at a fairly low phase angle on the dimmer.

For peak voltages falling within the range of overlap, at least one of two different techniques may be utilized to identify the transformer nominal voltage. First, the on time of the transformer may be compared to a predetermined threshold (e.g., stored within the processor and/or a memory associated therewith) beyond which the nominal voltage must be 12 V (because, e.g., a large on time would be necessary for the 12 V transformer to reach the region of overlapping voltage). Second, the ratio of on time to peak voltage may also be compared to another predetermined threshold beyond which the nominal voltage must be 12 V. In preferred embodiments, this second technique accounts for dimmers that have a naturally higher on time for low phase angles. In such cases, the on times may be increased, but the ratio of on-time-to-peak-voltage remains substantially constant and larger for a 12 V transformer (compared to a 24 V transformer).

The above-referenced predetermined thresholds may be established at least in part by characterizing a variety of dimmer and electronic transformer combinations at, e.g., minimum, mid-range, and maximum dimmer positions for 12 and 24 V. The digitized voltage and ratio of the peak voltage to the on time may be charted for these combinations. For voltages within the 12 V or 24 V ranges that are outside of the overlap region, a margin of, e.g., 2 V may be applied beyond the overlap region. For example, if the lower boundary of the overlap region is at 12 V, the peak measurement that would determine a 12 V system without further analysis may be at 10 V or below. For voltages within the overlap region, the peak voltage and on time may be analyzed. The boundaries therefor may be determined by the upper and lower limits that satisfy all of the cases in the characterization described above, plus adequate margin to account for noise variances and tolerances, e.g., approximately 10%.

Once the peak voltage of the transformer has been identified, one or more components or parameters in the system 100 may be adjusted accordingly. In one embodiment, a current supplied to an LED is adjusted such that it is less when a 24 V transformer is used and greater when a 12 V transformer is used. The amount of difference in the currents compensates for any user-perceivable difference in brightness the LED might experience due to the difference in transformer voltages. In one embodiment, the current is approximately 5% less in the case of the 24 V transformer than in the 12 V transformer. The current may be adjusted by varying its amplitude and/or duty cycle.

In another embodiment, the determined value of the peak value of the transformer voltage may be used to adjust an internal current to thereby protect a system component. In one embodiment, a bleeder circuit is used to draw a minimum level of current out of an electronic transformer at low phase angles to thereby prevent the transformer from stalling. A bleeder circuit (e.g., a resistor) that is "calibrated" for a 12 V transformer may, however, draw an unnecessarily high amount of bleeder current when used with a 24 V transformer, causing the bleeder circuit/resistor to overheat and/or otherwise fail. In this case, the bleeder current may be reduced accordingly to a lower level (i.e., a level high enough to prevent the 24 V transformer from stalling but low enough to avoid overheating and/or unnecessary power useage).

The processor and/or other modules described herein may be realized as software, hardware, or some combination thereof. The processor may also include a main memory unit for storing programs and/or data relating to the methods described above. The memory may include random access memory (RAM), read only memory (ROM), and/or FLASH memory residing on commonly available hardware such as one or more ASICs, FPGAs, electrically erasable programmable read-only memories (EEPROM), programmable read-only memories (PROM), programmable logic devices (PLD), or read-only memory devices (ROM). In some embodiments, the programs may be provided using external RAM and/or ROM such as optical disks, magnetic disks, or other storage devices.

For embodiments in which the functions of the processor are provided by software, the program may be written in any one of a number of high-level languages such as FORTRAN, PASCAL, JAVA, C, C++, C#, LISP, PERL, BASIC or any suitable programming language. Additionally, the software can be implemented in an assembly language and/or machine language directed to the microprocessor resident on a target device.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A method of determining a nominal voltage of a transformer electrically connected to an illumination system comprising a light source and a dimmer, the transformer supplying a voltage waveform having either a first nominal voltage or a second nominal voltage less than the first nominal voltage, each of the first and second nominal voltages falling within different but overlapping voltage ranges, the method comprising:

determining a peak voltage of the voltage waveform supplied by the transformer to the illumination system;

determining that the peak voltage falls within the overlapping voltage range;

determining a phase angle of the voltage waveform supplied by the transformer to the illumination system; and identifying the nominal voltage as either the first or second nominal voltage based at least in part on the phase angle.

2. The method of claim 1, further comprising adjusting a property of the illumination system in accordance with the identified nominal voltage.

3. The method of claim 2, wherein the adjusted property comprises a current supplied to an LED or a current drawn by a bleeder circuit.

4. The method of claim 1, wherein the nominal voltage is further determined by at least one of (i) comparing an on time of the voltage waveform to a predetermined threshold or (ii) comparing a ratio of the on time to the peak voltage to a second predetermined threshold.

5. The method of claim 4, wherein the on time is compared to the predetermined threshold, and further comprising:

if the on time is greater than the predetermined threshold, identifying the nominal voltage of the transformer as the second nominal voltage; and if the on time is less than or equal to the predetermined threshold, identifying the nominal voltage of the transformer as the first nominal voltage.

6. The method of claim 4, wherein the ratio of the on time to the peak voltage is compared to the second predetermined threshold, and further comprising:

if the ratio of the on time to the peak voltage is greater than the second predetermined threshold, identifying the nominal voltage of the transformer as the second nominal voltage; and if the ratio of the on time to the peak voltage is less than or equal to the second predetermined threshold, identifying the nominal voltage of the transformer as the first nominal voltage.

7. The method of claim 1, wherein the transformer is an electronic transformer or a magnetic transformer.

8. The method of claim 1, wherein the first nominal voltage is approximately 24 V and the second nominal voltage is approximately 12 V.

9. A method of determining a nominal voltage of a transformer supplying a voltage waveform to an illumination system, the method comprising:

determining a peak voltage of the voltage waveform supplied by the transformer to the illumination system;

determining an phase angle of the voltage waveform supplied by the transformer to the illumination system; and determining the nominal voltage based at least in part on the phase angle.

10. The method of claim 9, wherein the nominal voltage is determined by at least one of (i) comparing an on time of the voltage waveform to a predetermined threshold or (ii) comparing a ratio of the on time to the peak voltage to a second predetermined threshold.

11. The method of claim 9, further comprising adjusting a current supplied to an LED or a current drawn by a bleeder circuit in accordance with the determined nominal voltage.

12. A circuit for determining a nominal voltage of a transformer, the circuit comprising:

a comparator for (i) determining a peak voltage of a voltage waveform supplied by the transformer and (ii) determining a phase angle of the voltage waveform;

a memory for storing at least one predetermined threshold associated with at the phase angle; and an analyzer for determining the nominal voltage of the transformer based at least in part on the phase angle of the voltage waveform.

13. The circuit of claim 12, wherein the analyzer determines the nominal voltage of the transformer based in part on the peak voltage of the voltage waveform.

14. The circuit of claim 13, wherein the analyzer adjusts a current supplied to an LED or a current drawn by a bleeder circuit in accordance with the determined nominal voltage.

* * * * *